United States Patent [19]

Shelton

[11] 4,217,059

[45] Aug. 12, 1980

[54] VALVE SYSTEM FOR CONTROL OF PAINT TO SPREADER

[76] Inventor: James L. Shelton, 257 43rd Ave. NE., St. Petersburg, Fla. 33707

[21] Appl. No.: 19,316

[22] Filed: Mar. 9, 1979

[51] Int. Cl.[2] ..... B43M 11/02

[52] U.S. Cl. ..... 401/219; 401/270; 401/275

[58] Field of Search ..... 401/270, 272, 274, 275, 401/195, 219, 220, 204, 205, 206

[56] References Cited

U.S. PATENT DOCUMENTS

| | | | |
|---|---|---|---|
| 1,181,594 | 5/1916 | Hinkle | 401/275 |
| 1,205,714 | 11/1916 | Creech | 401/274 X |
| 2,731,656 | 1/1956 | Payne | 401/275 |
| 3,552,870 | 1/1971 | Brooks | 401/272 X |

*Primary Examiner*—John D. Yasko

*Attorney, Agent, or Firm*—Walter J. Monacelli

[57] ABSTRACT

The valve system described herein comprises a valve for controlling the flow of paint to a brush, roller or other paint spreading device which is actuated to permit the flow of paint through the valve by the pressure applied to the spreading device. The valve comprises a valve stem having an opening therein for the flow of paint, a valve head fastened rigidly to the valve stem and a chamber in which a lower part of the wall thereof comprises a valve seat. This system operates in such a manner that a pressure applied at an angle to the linear axis of the valve stem tilts the valve head against one portion of the adjacent valve seat thereby pressing one side of the valve head out of normal position so that there is an open space between the valve head and the valve seat through which paint may flow into the opening in the valve stem and ultimately into the paint spreading device.

9 Claims, 17 Drawing Figures

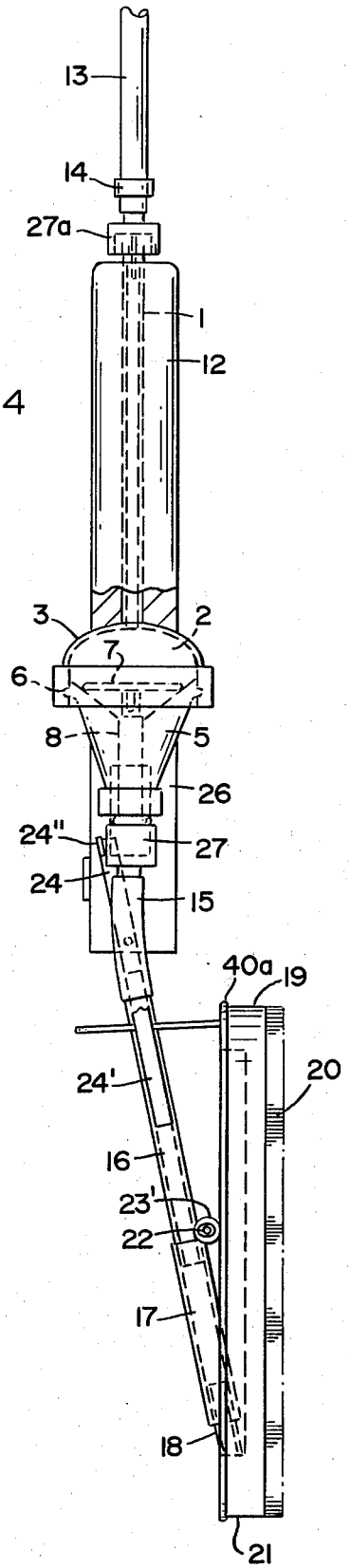
FIG. 4
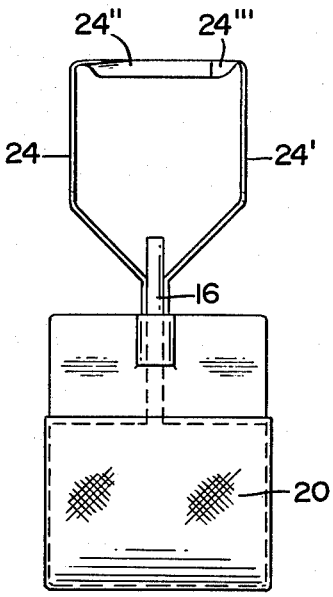
FIG. 7
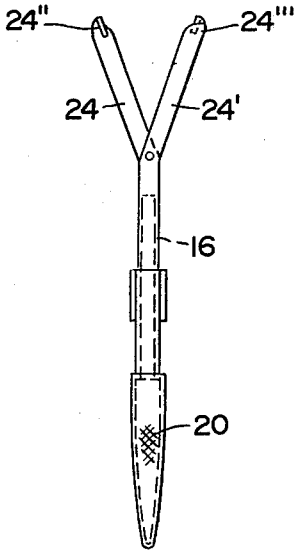
FIG. 7A
FIG. 8
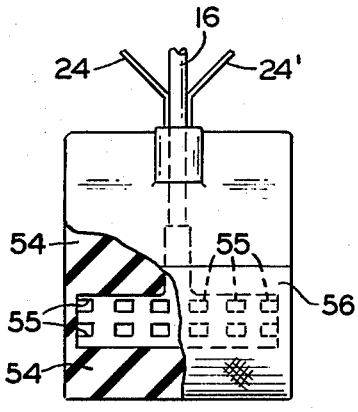
FIG. 9
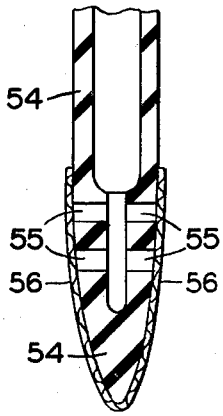

FIG. 10
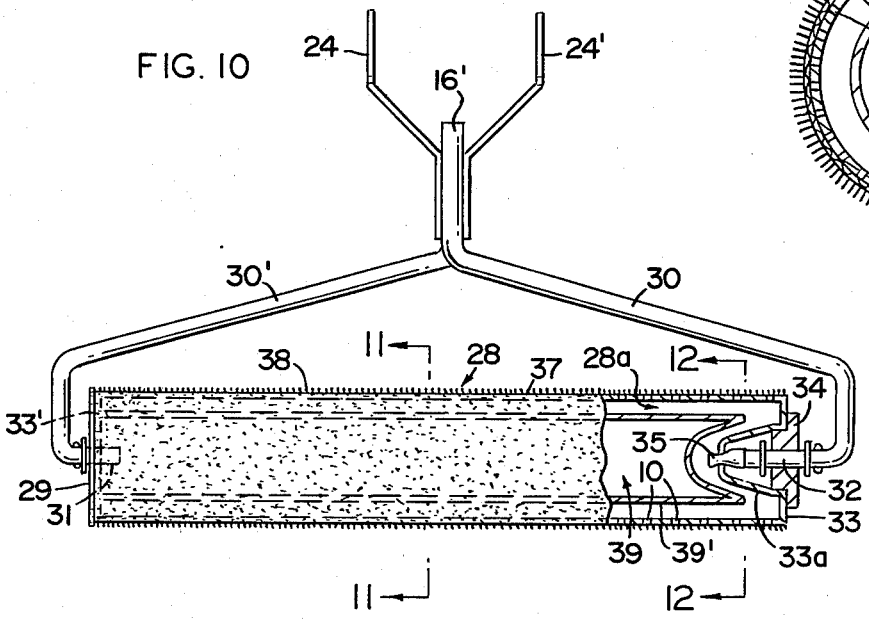
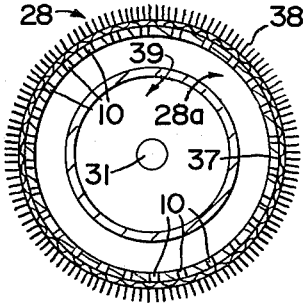
FIG. 11
FIG. 12A
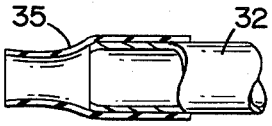
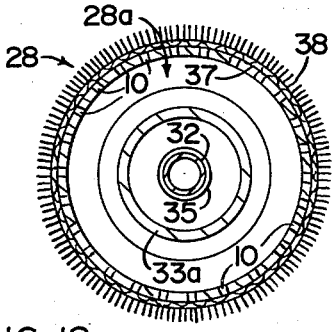
FIG. 12
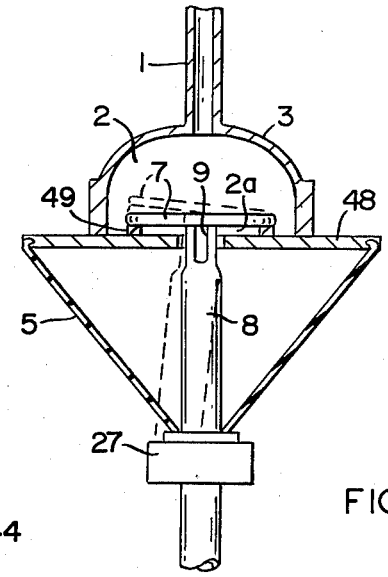
FIG. 15
FIG. 13
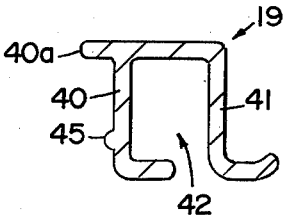
FIG. 14
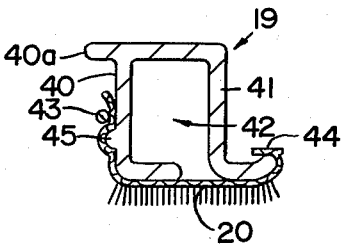

VALVE SYSTEM FOR CONTROL OF PAINT TO SPREADER

BACKGROUND OF THE INVENTION

1. Field of the Invention

This invention relates to a device for dispensing paint easily and smoothly to a surface. More specifically it relates to a valve system for controlling the flow of paint to a paint-spreading device. Still more specifically it relates to a valve system actuated to permit the flow of paint by manual pressure applied to the paint-spreading device.

2. State of the Prior Art

There have been a number of systems proposed for controlling the flow of paint to brushes and rollers. Typical are those described in U.S. Pat. Nos. 1,254,429; 1,342,212; 1,441,675; 1,960,071; 3,195,170; 3,340,573; 3,321,795 and 3,337,899. In each case the flow of the paint is turned on or off by a valve which is actuated by the finger, thumb or hand of the operator. None of these show activation by the manual pressure applied to the paint-spreading device or turned off by release of this manual pressure. Nor do any of them show any control for the rate of flow in accordance with the amount of manual pressure applied to the paint-spreading device.

SUMMARY OF THE INVENTION

In accordance with the present invention, it has been found that the flow of paint to a spreading device may be easily controlled by the manual pressure applied on the spreading device in moving it over the surface to be painted. This is effected by a novel valve system comprising a hollow valve stem rigidly attached to a valve head which rests against a valve seat in the lower portion of a reservoir chamber containing paint. As manual pressure is applied to the paint brush, roller or other spreading device, this applies pressure against the valve stem at an angle to the linear axis of the stem. This in turn presses the valve head away from one area of the valve seat on which it rests, thereby leaving a space between the valve head and the valve seat. This permits paint, which is in contact with the side of the valve head opposite from the side connected to the valve stem, to flow through the aforesaid opened space into an opening in the valve stem, through the hollow valve stem and to the paint-spreading device.

The valve system of this invention operates automatically in accordance with the manual pressure applied to the paint spreading device. This may be used interchangeably with various paint spreading devices such as brushes, rollers and fabric covered devices adapted to have the paint fed internally thereto under pressure, either superatmospheric or gravity pressure, preferably at about 5 psi or more. The term "fabric" is used herein to include cloth, felt and other porous materials fabricated from fibers and other materials as indicated herein.

BRIEF DESCRIPTION OF THE DRAWINGS

Description of the device of this invention is facilitated by reference to the drawings in which:

FIG. 4 is a side elevational view with partial cutaway of a portion of the view of FIG. 3;

FIG. 7 is a front elevational view of a paint brush modified by a fabric covering and adapted to be used with the valve of FIG. 1;

FIG. 7*a* is a side view of the spreader of FIG. 7;

FIG. 8 is a similar view of a paint spreader having a flexible manifold;

FIG. 9 is a cross-sectional side view of the tip of the paint brush of FIG. 8;

FIG. 10 is a front elevational view with partial cutaway section of a paint roller adapted to be used with the valve of FIG. 1;

FIG. 11 is a side elevational cross-sectional view of the roller portion of FIG. 10 taken at 11—11;

FIG. 12 is a side elevational cross-sectional view of the roller portion of FIG. 10 taken at 12—12;

FIG. 12*a* is a partial cross-sectional side elevational view of the tube feeding into the interior chamber of the roller shown in FIG. 10;

FIG. 13 is a cross-sectional view of the construction of the spreader 19 of FIG. 3;

FIG. 14 is a similar view as in FIG. 13 with fabric attached; and

FIG. 15 is a cross-sectional view of another modification of the valve of this invention.

DETAILED DESCRIPTION

Figure 1:
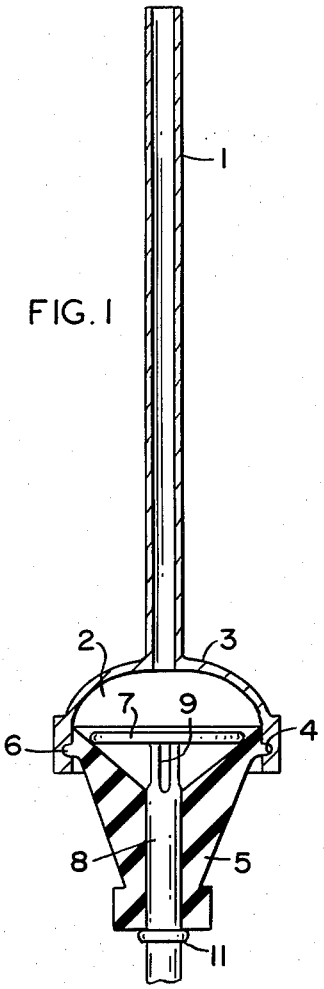
FIG. 1 shows a vertical cross-sectional view of one modification of the valve of this invention in closed position.
Figure 2:
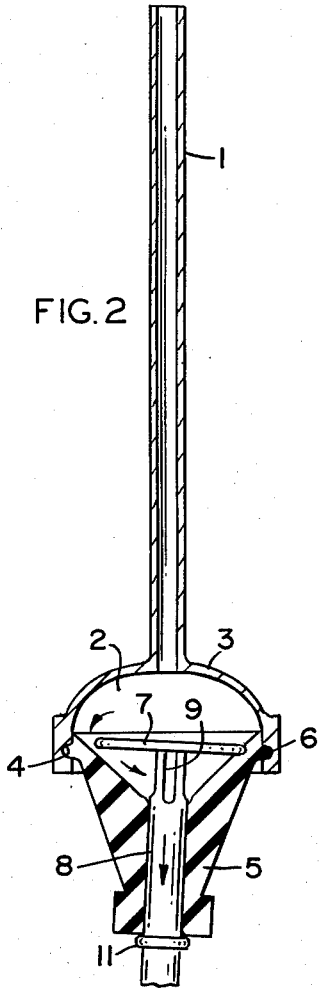
FIG. 2 shows the same view of the valve modification of FIG. 1 in open position.

In the modification shown in FIGS. 1 and 2 the valve comprises a feed tube 1 which is preferably made of metal or plastic and feeds into chamber 2 defined by chamber wall 3 which has a groove 4 around the lower interior wall of chamber wall 3 into which valve seat 5 is fitted by rim or lip 6 to provide a tight seal. Valve seat 5 is made of soft, resilient rubber or similar material. When paint flow is not desired, valve head 7 rests on valve seat 5 sealing off the flow of paint from chamber 2. Valve head 7 is connected to hollow valve stem 8 which has openings 9 connecting the interior of the valve stem to the exterior. When lateral pressure is applied to valve stem 8 the valve head 7, as shown in FIG. 2, is depressed into the flexible valve seat 5 on one side and moves away from the opposite side to leave the opening indicated at the arrow with the result that paint flows through this opening from chamber 2 into the lower region and through openings 9 into the interior of valve stem 8 and ultimately through the paint-spreading or dispensing device. Ridge 11 aids in positioning of valve seat 5 on valve stem 8.

Figure 3:
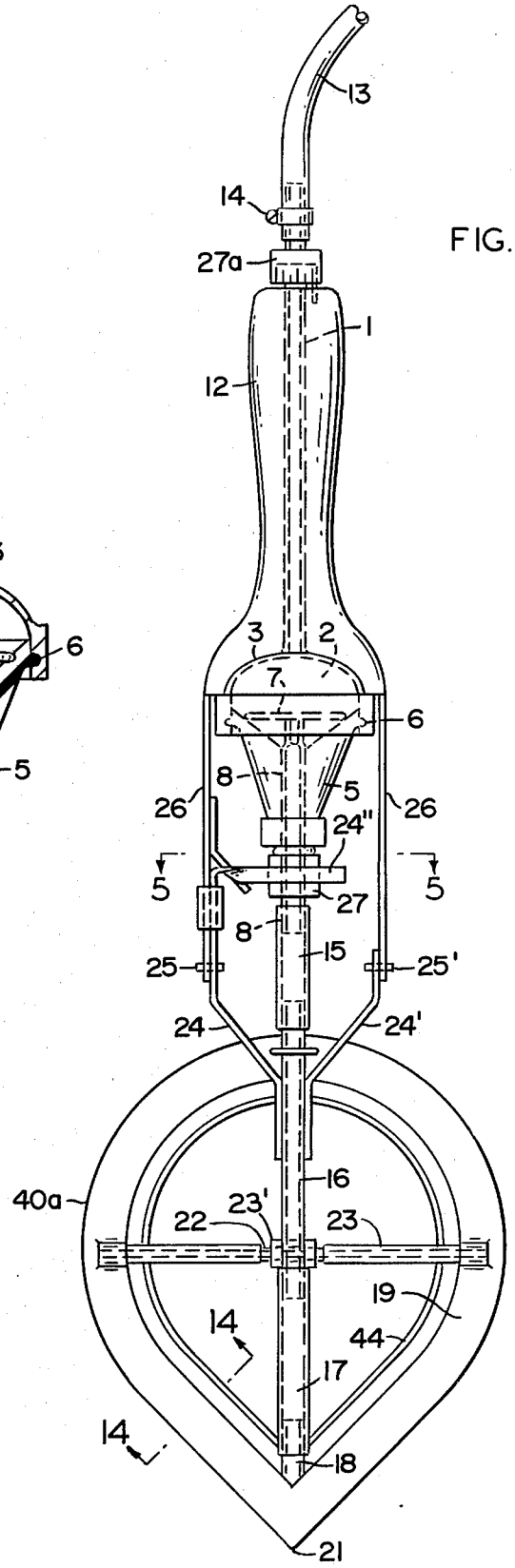
FIG. 3 is a front elevational view of a modification of this invention in which the valve of FIG. 1 is incorporated as an integral part of a handle for use with a specially designed paint spreading device.
Figure 5:
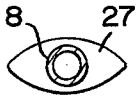
FIG. 5 is a top view of the adjustable knob shown as part of FIG. 3.
Figure 6:
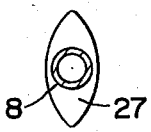
FIG. 6 is a top view of the knob of FIG. 5 shown adjusted to a different position.

FIGS. 3 and 4 show the valve of FIGS. 1 and 2 incorporated into a paint spreading device with feed tube 1 fitted into an opening in handle 12. A paint supply source, preferably under about 5 psi or more of pressure, is connected by tube 13 and held securely by clamp 14. Valve stem 8 is connected by a very thin, flexible tube 15 to metal or plastic tube 16 and thereby to flexible tube 17 and metal or plastic tube 18 to the interior of spreader 19. This spreader comprises a heart-shaped or triangular-shaped hollow tubed device having an opening (not shown here) through which paint is fed onto a porous absorbent fabric 20 covering the bottom of spreader 19. Spreader 19 has a pointed section 21 to enable spreading paint into corners. Spreader 19 has the ends of bar 22 attached thereto and sleeves 23 encircle bar 22 and hold small sleeve 23' in a central position. Small sleeve 23' can be rigidly attached to tube 16 or molded as a part of tube 16. It is constructed in such a manner that spreader 19 may be pivoted both longitudinally and latitudinally. As manual pressure is applied against the spreader by placing it on the surface to be painted, this pivots the spreader and applies pressure on metal tube 16 and attached toggle arms 24 and 24' which are pivotably connected by pins 25 and 25' to frame arms 26 which are extensions of the handle 12. The pivoting of arm 24 causes its upper portion or wobble arm 24'' to strike knob 27. Knob 27 is shown in two positions in FIGS. 5 and 6 which are adjusted by the dial **27*a*. The position of knob 27 determines whether the pressure of the spreader 19 is transmitted with a smaller or larger pivoting of arm 24. This affects also the degree by which the valve head 7 is displaced from its sealing position as shown in FIG. 1. The more valve head 7 is displaced, the larger will be the open space provided for flow of paint and therefore the faster the flow of paint. Thus the position of the knob as shown in FIG. 5 will provide zero rate of flow and that shown in FIG. 6** will provide the fastest rate. Intermediate adjustments will provide intermediate flow rates.

FIG. 7 shows a paint brush having a tube 16 to feed paint into the spaces between the bristles. While a fabric 20 is shown over the bristles as a modification, it is also possible to rely somewhat on only the bristles for dispersing the paint. Arms 24 and 24' have wobble arms 24'' and 24''' attached thereto and positioned so that wobble arm 24'' will strike the knob 27 when pressure is applied on one side of the brush and wobble arm 24''' will strike knob 27 from the other side when pressure is applied on the opposite side of the brush. The opposite positioning of the wobble arms 24'' and 24''' is shown in FIG. **7*a*. These opposite wobble arms may also be part of a rectangle which surrounds the knob 27. In wide brushes, tube 16** may feed into a plurality of branch tubes for distribution into the brush portion.

FIG. 8 shows a brush in which the bristles are omitted and the paint distributed through the openings 55 in manifold 54 which is covered with an absorbent porous fabric 56 through which the paint permeates. Fabric 56 is advantageously bonded or glued to at least a portion of manifold 54 to prevent bulging. The bonding between the fabric and the manifold should be at least around the periphery of that area where the openings 55 are located and advantageously not in the areas between these openings. Preferably the bonding is effected in all contact areas between the fabric and the manifold except in the areas between openings. If desired, one or more additional layers of fabric may be used, preferably detachable for removal.

FIG. 9 shows a cross-section of the tip of the design shown in FIG. 8,

FIG. 10 shows a paint roller 28 designed for use with the valve system of this invention. Tube 16' corresponds to tube 16 of FIG. 3 and may be inserted similarly in flexible tube 15 for substitution of the roller device of FIG. 10 in place of the paint spreader device shown in FIG. 3. Toggle arms 24 and 24' are attached to tube 16' and extend upward in a manner, possibly with a cross-arm extension or extensions as shown in FIG. 3 to engage knob 27 and thereby effect the pressure necessary for activating the paint release valve. Tube 16' extends into hollow arm 30 through which paint will flow into the paint chamber **28*a* of roller 28. Support arm 30' may be a solid arm attached to tube 16' and extending to the opposite end 33' of the roller from the feed end and has an axle arm 31 extending through an axial opening in the end wall 33' of the roller. The roller is rotatable about axle arm 31 and the extension 32 of the hollow handle arm which fits through an axial opening in fitting 34 inserted into end wall 33. The end wall 33 is shaped inwardly at 33*a* and has an opening through which tube 35 is rotatably inserted and sealed to the interior of wall 33*a*. Fitting 34 and end wall 33*a* rotate about extension 32 and tube 35 respectively, but tube 35 fits snugly enough against wall 33*a* to provide a seal against the escape of paint. Disc 29 is attached to end wall 33' and extends as far or almost as far as the fabric so that when the fabric is in contact with the painting surface the peripheral surface of the disc, preferably serrated, will touch the surface being painted and the friction therewith will provide the rotating force. Paint flows from the interior of rubber tube 35 into paint chamber 28*a*. The exterior wall 37 of the paint chamber has openings 10 therein which permit the flow of paint into and through the permeable fabric 38 which effects the spreading of paint on the surface to be coated. Inner chamber 39 is kept free of paint thereby giving a shorter lag time in applying paint, keeping the roller lighter during use, and avoiding waste of paint. Cylindrical wall 39' separates paint chamber 28*a* from inner chamber 39. Arm 30' has sufficient spring and resiliency to enable removal of axle arm 31 from the roller for disassembling and cleaning or replacing the roller. Fabric 38** may be removed for cleaning or replacement or bonded if desired.

FIGS. 11 and 12 further illustrate, by cross-section, the details of the interior of the roller.

FIG. 13 shows by cross-section the interior construction of the paint spreader of FIGS. 3 and 4, and FIG. 14 shows also by cross-section the same paint spreader with fabric attached. Arms 40 and 41 embrace a paint channel 42 which passes the length and contour of the spreader and when covered by permeable fabric 20, supplies the paint to be spread. Retaining rings 43 and 44 are advantageously bonded to the fabric and ridge 45 may be provided to give further support for retaining the fabric in position. Ridge 45 is not shown in FIGS. 3 and 4 and may be omitted, particularly where the fabric is bonded or glued to arms 40 and 41. Guiding edge **40*a*** is helpful in keeping paint off a surface perpendicular to that which is being painted.

FIG. 15 shows another modification of the valve of this invention. In FIG. 15, paint feed tube 1 feeds paint into chamber 2 which has a rigid wall 3 and at the bottom is glued to rigid plate 48. Valve head 7 has rubber ring 49 glued at the bottom thereof and ring 49 rests against rigid plate 48 in normal position to provide a seal against the flow of paint. Alternatively, rubber or other resilient ring 49 may be glued to plate 48 instead of the valve head 7 and pressed against the valve head to provide the seal. When valve stem 8 is tilted, as shown by the dotted lines, the flexible wall 5 bends to permit movement of valve head 7 and rubber ring 49 accordingly, to open a space between rubber ring 49 and plate 48 to allow paint to flow from the upper chamber section 2 into the lower section **2*a*, into port openings 9 and through valve stem 8** to the paint spreading device.

An important feature of this invention is the fact that the wobble arm 24" is moved or actuated against the clearance knob 27 so that it tilts the valve stem 8 thereby separating valve head 7 from valve seat 5, thereby allowing paint to flow from one chamber to the other and thereafter through the port holes or openings in the valve stem to the paint dispensing or spreading device. The distance that the wobble arm may travel after it has contacted the knob is limited to an appropriate distance by a stop or pin positioned in the path of the wobble arm. When the pressure from the paint spreading device to the valve stem is released, the valve stem returns to its normal position and stops the flow of paint.

Various designs of the wobble arm may be used provided the appropriate pressure is exerted against the knob to tilt the valve stem. Adjustment of the clearance knob is provided so that variations in the rate of flow may be effected by the size of opening effected by the degree of tilting of the valve stem. The wobble arm may be two-pronged so that, particularly with the brush type spreader, pressure from either side of the brush or spreader will effect contact with the knob and consequent unseating of the valve head from the valve seat.

It is also possible to have greater flow on one side of the brush or paint applier than on the other side. This is effected by bending the appropriate wobble arm away from the clearance knob. The amount of clearance may be adjusted by turning the calibrated dial 27*a* at the top of the handle which is attached to feed tube 1 and accordingly will turn knob 27. Dial 27*a* may have a pin in its interior which will limit the turning thereof to a desired degree.

Construction is such that a certain minimum pressure is required before sufficient movement of the valve stem will be effected to cause paint flow through the valve. This will permit the painting head to align itself with the surface being painted and allow light strokes to use the amount of paint already on the brush without causing additional flow, and also for removing slight irregularities in the painted surface.

The flexibility of the very thin, flexible tubing or coupling 15 should be such that any distortion thereof will not actuate the metering valve. Moreover, the torsional rigidity of this flexible coupling should not be sufficient that distortion caused by turning knob 27*a* would affect the operation of the metering valve.

While the various figures and the description, for the purpose of simplicity, picture the feed tube and feed chamber at the top and the valve and paint dispenser in the lower regions, it is possible, because of the pressure under which the paint is being delivered, to have these inverted, particularly when paint is being applied to a ceiling or to an upper wall region. However, reference is made to upper and lower regions to simplify the description.

Furthermore, although the paint roller shown in FIG. 10 has one hollow arm through which paint may be fed to the interior of the roller, appropriate changes in the design may be made for the use of two hollow arms for feeding paint to the interior chamber.

In the various spreading devices fabric is advantageous as the means for effecting the spreading of the paint. Various types of fabric may be used provided it has the absorbency and permeability to effect smooth spreading of the paint, and also has chemical compatibility or inertness to the paint being used. Particularly preferred for this purpose and included within the expression "fabric" is a flexible porous thin rubber sheet material having fibers running perpendicular to the plane of the material on the side which is to be in contact with the surface being painted. This thin rubber sheet has openings therein approximately equivalent in number and size to the openings in other suitable cloths or fabrics.

The fabrics used for this purpose impede the escape of paint sufficiently so that the paint spreads over the inner surface or face of the fabric and is allowed to flow at the appropriate rate through the pores of the fabric. The fabric material advantageously may have short fibers extending outwardly, preferably perpendicular, from the surface of the cloth. The pores or opening in the fabric should be sufficiently small to restrain the paint from pouring through too quickly and to effect uniform passage through pores in the entire spreading area of the fabric. The actual size of the openings will be selected also in accordance with the viscosity of the paint and the pressure applied to the paint. The rate of flow through the fabric may also be controlled somewhat by the pressure applied on the paint supply. If desired, two or more lengths of fabric may also be used to control the flow of paint, depending on the permeability, flexibility, absorbency and resiliency.

The fabric may be of any desired type of fiber such as cotton, rayon, wool, nylon, silk, cellulose acetate, polyester, orlon, etc., provided it has the desired degree of porosity as described above. It is also desirable to have an appropriate amount of absorbency of the paint into the fabric depending on the type of paint used. Latex paints are desirable for easy cleaning of the valve and spreading system, which requires merely rinsing in water. However, oil base paints may also be used easily, in which case the cleaning operation is effected with petroleum solvent or thinner.

For cleaning the brush, roller or spreading pad, a pressurized container may be used with cleaning liquid, such as water for latex paints and petroleum solvent or thinner with oil-based paints, and thereby pump the cleaning fluid through the system. With latex paint an adapter may be used to connect the system with a tap water supply for the cleaning operation.

The valve system of this invention has many advantages. First it is very easy to apply an even coat of paint. Secondly, there is very little waste. Third, the paint application proceeds very easily and quickly with very little wasted motion. Fourth there is little need for cleaning up surrounding areas of sprayed or splashed paint. Fifth, because of the little effort required by the painter, wider brushes or applicators may be used, therefore requiring fewer strokes and less wasted effort. Sixth, the possibility of leaving brush stroke marks is avoided or reduced.

Moreover the various types of applicators and sizes of applicators are interchangeable with the valve system of this invention and allow flexibility in accordance with the particular area or type of surface being painted. Furthermore, other shapes of applicators may be used.

While certain features of this invention have been described in detail with respect to various embodiments thereof, it will of course be apparent that other modifications can be made within the spirit and scope of this invention, and it is not intended to limit the invention to the exact details shown except insofar as they are defined in the following claims:

The invention claimed is:

1. A paint application system comprising:

(a) a paint source adapted to supply paint at a pressure of at least the force of gravity;

(b) a metering valve system comprising:

(i) a handle having an interior opening extending lengthwise therethrough;

(ii) a supply tube extending through said opening in said handle, said tube being connected to and adapted to have paint from said paint source flow therethrough;

(iii) a valve communicating with the interior of said supply tube and attached to that end of said supply tube opposite from the end connected to said paint source comprising a chamber having an upper section and a lower section and an opening at the lower region of said lower section, a hollow valve stem extending upwardly through said opening having one or more port holes therein, a valve head rigidly attached to the upper end of said valve stem and resting against a surface in said chamber in such a manner to separate and seal the said upper section of said chamber from the lower section of said chamber, and so adapted that a sideway thrust applied at the lower end of said valve stem will cause the attached valve head to separate from the said surface at one side of said valve head, thereby opening a passageway between the upper and lower sections of said chamber and allowing fluid which may be contained in said upper chamber section to flow into said lower chamber section, through said port openings and through the hollow valve stem;

(iv) a paint dispensing means connected to and communicating with the interior of said valve stem and adapted to exert lateral pressure at the connecting end of said valve stem when manual pressure is applied for the application of paint by said paint dispensing means and thereby to actuate the partial unseating of said valve head whereby paint is allowed to flow through said valve to said paint dispensing means.

2. The paint dispensing system of claim 1 in which said lower chamber section is substantially conically shaped and said valve head rests against the wall of said lower substantially conical section in such a manner as to seal said upper section of said chamber from the conical section thereof and adapted upon the application of a lateral pressure on the opposite end of said valve stem to separate one side of said valve head from the wall of said conical section, thereby to allow the flow of paint from the said upper section to the conical portion of said chamber and through said valve stem to said paint dispenser.

3. The paint dispensing system of claim 1 in which said paint dispensing means comprises a device having at one end thereof a substantially triangular shape and having an inverted open channel with the open portion of said channel covered by absorbent porous fabric capable of having paint permeate therethrough at a controlled rate, said channel having an opening connecting to the extremity of said valve stem opposite from said valve head whereby paint passing through said valve stem is fed into said channel and eventually through the permeable pores in said fabric for application to the surface to be painted.

4. The paint dispensing system of claim 1 in which said paint dispensing means comprises a brush having a tube feeding into the bristles of said brush by means of a manifold having a number of openings along the width of said brush, said feed tube being connected to the said valve stem and adapted to receive and dispense paint flowing through said valve stem.

5. The paint dispensing system of claim 4 in which said paint brush is covered with an absorbent, porous fabric through which the paint permeates for application to the surface to be painted.

6. The paint dispensing system of claim 1 in which said paint dispensing means is shaped similar to a brush but instead of bristles has a flexible manifold and a tube connecting said manifold with said valve stem, said flexible manifold being covered by absorbent, porous fabric and adapted to feed the paint received from said valve stem to a plurality of openings therein and through the porous fabric to the surface to be painted.

7. The paint dispensing system of claim 1 in which said paint dispensing means comprises a paint roller adapted so that said valve stem feeds paint through at least one hollow arm of said roller, said roller having a double walled compartment; the outer wall of said compartment comprising the outer cylindrical surface of said roller and the other wall of said compartment comprising a second cylinder concentric with and spaced a short distance inside said outer wall, the end walls of said roller sealing the said compartment except for an opening connecting to said hollow arm or said roller through which paint may flow to the interior of said compartment, said outer wall of said compartment having a plurality of openings therein and having cylindrical absorbent, porous fabric covering said cylindrical wall and adapted to have the paint entering said compartment flow out said wall openings and permeate through said fabric.

8. The paint dispensing system of claim 7 in which one of said end walls is extended so as also to be in contact with the surface being painted by means of said fabric, whereby friction of said extended end wall with said surface serves to rotate said roller.

9. The paint dispensing system of claim 8 in which said extension comprises a thin disc attached to said end wall and extending slightly beyond the cylindrical surface of said roller.

* * * * *